US007286107B2

(12) United States Patent
Lee et al.

(10) Patent No.: US 7,286,107 B2
(45) Date of Patent: Oct. 23, 2007

(54) LIQUID CRYSTAL DISPLAY

(75) Inventors: Dai Yun Lee, Kyounggi-do (KR); Han Sang Lee, Kyounggi-do (KR); Nam Wook Cho, Kyounggi-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 725 days.

(21) Appl. No.: 10/826,282

(22) Filed: Apr. 19, 2004

(65) Prior Publication Data

US 2005/0140638 A1 Jun. 30, 2005

(30) Foreign Application Priority Data

Dec. 30, 2003 (KR) ..... 10-2003-0099805

(51) Int. Cl.
*G09G 3/20* (2006.01)

(52) U.S. Cl. ..... 345/92; 345/205; 349/42

(58) Field of Classification Search ..... 345/91–92, 345/205–206, 98–99, 103, 87; 349/41–42, 349/48

See application file for complete search history.

(56) References Cited

U.S. PATENT DOCUMENTS 6,982,690 B2 * 1/2006 Lee et al. ..... 345/87

* cited by examiner

*Primary Examiner*—Richard Hjerpe
*Assistant Examiner*—Abbas Abdulselam
(74) *Attorney, Agent, or Firm*—Birch, Stewart, Kolasch & Birch, LLP

(57) ABSTRACT

A LCD is adapted to reduce the number of data lines and drive circuits. The LCD can be driven in a dot inversion manner, using a data driver employing column inversion. A gate driver sequentially supplies first and second gate signals to gate lines. First and second switching parts are located in an $i^{th}$ horizontal line and supply video signals from data lines to LC cells by the control of an $i^{th}$ gate line. Third switching parts supply video signals to the cells located in the horizontal line, and are connected to the same data line as the second switching part, and are controlled by the $i^{th}$ and an $i-1^{th}$ gate lines. Fourth switching parts supply video signals to the cells located in the horizontal line and are connected to the same data line as the first switching part, and are controlled by the $i^{th}$ and $i-1^{th}$ gate lines.

32 Claims, 12 Drawing Sheets

FIG. 3A
RELATED ART

| | | | | | | | |
|---|---|---|---|---|---|---|---|
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |
| + | − | + | − | + | − | + | − |

FIG.3B
RELATED ART

| | | | | | | | |
|---|---|---|---|---|---|---|---|
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |
| − | + | − | + | − | + | − | + |

FIG. 4A
RELATED ART

| | | | | | | | |
|---|---|---|---|---|---|---|---|
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |

FIG. 4B
RELATED ART

| | | | | | | | |
|---|---|---|---|---|---|---|---|
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |
| − | + | − | + | − | + | − | + |
| + | − | + | − | + | − | + | − |

LIQUID CRYSTAL DISPLAY

This Nonprovisional application claims priority under 35 U.S.C. § 119(a) on Patent Application No(s). P2003-99805 filed in Korea on Dec. 30, 2003, the entire contents of which are hereby incorporated by reference.

BACKGROUND OF THE INVENTION

1. Field of the Invention

The present invention relates to a liquid crystal display and more particularly to a liquid crystal display that is adapted to reduce the number of data lines and data drive integrated circuits corresponding to the data lines. The liquid crystal display of the present invention can be driven by a dot inversion system, using a data driver employing a column inversion method.

2. Description of the Related Art

A liquid crystal display controls the light transmittance of liquid crystal materials by using an electric field to display a picture. To this end, the liquid crystal display includes a liquid crystal display panel having a pixel matrix and a driving circuit for driving the liquid crystal display panel. The driving circuit drives the pixel matrix, so that picture information can be displayed on the display panel.

FIG. 1 illustrates a liquid crystal display, in accordance with the background art. In FIG. 1, the liquid crystal display includes a liquid crystal display panel 2. A data driver 4 drives data lines DL1 to DLm of the liquid crystal display panel 2. A gate driver 6 drives gate lines GL1 to GLn of the liquid crystal display panel.

The liquid crystal display panel 2 includes a thin film transistor (TFT) formed at each intersection of the gate lines GL1 to GLn and the data lines DL1 to DLm. The liquid crystal display panel 2 also includes liquid crystal cells connected to the thin film transistors and arranged in a matrix.

The gate driver 6 sequentially applies gate signals to the gate lines GL1 to GLn, in accordance with control signals from a timing controller (not shown). The data driver 4 converts data relating to the colors to be displayed, red (R), green (G) and blue (B), supplied from the timing controller, into video signals as analog signals. The data driver 4 applies the video signals for one horizontal line portion to the data lines DL1 to DLm, for every horizontal period as the gate signals are applied to the gate lines GL1 to GLn.

The thin film transistor (TFT) applies the data from the data lines DL1 to DLm to the liquid crystal cells in response to the gate signals from the gate lines GL1 to GLn. The liquid crystal cell is composed of a pixel electrode connected to the TFT and a common electrode, facing each other with liquid crystal therebetween. Thus, the arrangement is equivalent to a liquid crystal capacitor Clc. Such a liquid crystal cell includes a storage capacitor (not shown) connected to a previous gate line in order to sustain the data voltage charged in the liquid crystal capacitor Clc until the next data voltage is charged.

In this way, the liquid crystal cells of the liquid crystal display panel are located at intersections of the gate lines GL1 to GLn and the data lines DL1 to DLm, respectively. Thus, the number of vertical lines equals the number of data lines DL1 to DLm, i.e. there are m-number of vertical lines. In other words, the liquid crystal cells are arranged in a matrix to form m-number of vertical lines and n-number-of horizontal lines, corresponding to the number of the data lines DL1 to DLm and the gate lines GL1 to GLn, respectively.

As can be seen in FIG. 1, m-number of data lines DL1 to DLm are required to drive the liquid crystal cells formed into the m-number of horizontal lines. Accordingly, there is a disadvantage that a lot of processing time is spent because m-number of data lines (DL1 to DLm) are required to drive the liquid crystal display panel 2 of the background art. Moreover, there is a disadvantage that a lot of fabrication and design costs are required to manufacture the m-number of data lines (DL1 and Dlm) and the associated data driver integrated circuits (ICs) for driving the data lines DL1 to DLm.

In order to drive the liquid crystal cells on the liquid crystal display panel, the liquid crystal display device can employ an inversion driving method. Inversion driving methods include a frame inversion system, field inversion system, line (column) inversion system, and dot inversion system. In the frame inversion system, the polarity of the video signal applied to the liquid crystal cells on the liquid crystal display panel are inverted whenever the frame is changed.

In the line in-version system driving method of the liquid crystal display panel, the polarities of the video signals applied to the liquid crystal display panel are as shown in FIGS. 2A and 2B. The horizontal lines are inverted for each gate line of the liquid crystal display panel and for each frame. Such a line inversion system has a disadvantage in that flickers, such as stripe patterns, are generated between horizontal lines. The flickers occur because crosstalk exists between pixels in a horizontal direction.

In the column inversion system driving method of the liquid crystal display panel, the polarities of the video signals applied to the liquid crystal display panel are as shown in FIGS. 3A and 3B. The vertical or column lines are inverted for each data line of the liquid crystal display panel and for each frame. Such a column inversion system has a disadvantage in that flickers, such as stripe patterns, are again generated between vertical lines. Again, the flickers occur because crosstalk exists between pixels in a vertical direction.

In the dot inversion system driving method of the liquid crystal display panel, the polarities of the video signals applied to the liquid crystal display panel are as shown in FIGS. 4A and 4B. A video signal with its polarity contrary to those of the liquid crystal cells, which are adjacent thereto in a vertical and a horizontal direction, is applied to each liquid crystal cell. The polarities of the video signals are inverted for each frame.

In the dot inversion system, FIG. 4A illustrates when video signals of an odd-numbered frame are displayed. The video signals are supplied to the liquid crystal cells, respectively, for a positive (+) polarity and a negative (−) polarity to appear alternately as it progresses from top-left to right and down to the bottom in the liquid crystal cells. FIG. 4B illustrates when video signals of an even-numbered frame are displayed. The video signals are supplied to the liquid crystal cells, respectively, for the negative (−) polarity and the positive (+) polarity to appear alternately as it progresses from top-left to right and down to the bottom in the liquid crystal cells.

The dot inversion driving method causes the flickers, occurring among pixels adjacent in the vertical direction and adjacent in the horizontal direction, to offset each other. By this arrangement, pictures of better quality than the other inversion systems can be displayed.

However, in the dot inversion driving method, since the polarity of the video signal applied from the data driver to the data lines is inverted in a vertical and a horizontal direction, there is a disadvantage that the data driving method requires more power consumption than the other inversion systems. More power is required because of the amount of the change of a pixel voltage, that is, a high frequency of the video signal.

SUMMARY OF THE INVENTION

Accordingly, it is an object of the present invention to provide a liquid crystal display that is adapted to reduce the number of data lines and data drive integrated circuits corresponding to the data lines. The liquid crystal display can be driven with a dot inversion method, while using a data driver of a column inversion method.

In order to achieve these and other objects of the invention, a liquid crystal display includes a data driver for supplying video signals to data lines by a column inversion method; a gate driver for sequentially supplying a first and a second gate signals, to gate lines; a plurality of first switching parts and a plurality of second switching parts located at an $i^{th}$ (i is a natural number) horizontal line for supplying the video signals to liquid crystal cells by the control of the $i^{th}$ gate line; a plurality of third switching parts located at the $i^{th}$ horizontal line and connected to the same data line along with the second switching part adjacent thereto for applying the video signals to the liquid crystal cells by the control of the $i^{th}$ gate line and an $i-1^{th}$ gate line; and a plurality of fourth switching parts located at an $i^{th}$ horizontal line and connected to the same data line along with the first switching parts adjacent thereto for applying the video signals to the liquid crystal cells by the control of the $i^{th}$ gate line and the $i-1^{th}$ gate line.

The first gate signal supplied to the $i^{th}$ gate line is supplied overlapping with the second gate signal applied to the $i-1^{th}$ gate line.

The first gate signal supplied to the gate line rises along with the second gate signal applied to the $i-1^{th}$ gate line at the same point in time.

The width or duration of the first gate signal is set to be approximately half of the width or duration of the second gate signal.

The first to the fourth switching parts are arranged in a zigzag pattern on the basis of the data line for each horizontal line.

Each of the first switching parts located at the $i^{th}$ horizontal line includes a first thin film transistor connected to an odd-numbered data line and the $i-1^{th}$ gate line. A second thin film transistor is connected to the first thin film transistor and the $i-1^{th}$ gate line and connected to a liquid crystal cell located at a $j^{th}$ (where j is 2, 6, 10, . . . ) vertical line.

Each of the second switching parts located at the $i^{th}$ horizontal line includes a first thin film transistor connected to an even-numbered data line and the $i-1^{th}$ gate line. A second thin film transistor is connected to the first thin film transistor and the $i-1^{th}$ gate line and connected to a liquid crystal cell located at a $j+1^{th}$ (where j is 2, 6, 10, . . . vertical line.

Each of the third switching parts located at the $i^{th}$ horizontal line includes a first thin film transistor connected to an even-numbered data line and the $i-1^{th}$ gate line. A second thin film transistor is connected to the first thin film transistor and the $i^{th}$ gate line and connected to a liquid crystal cell located at a $j-1^{th}$ (where j is 2, 6, 10, . . . ) vertical line.

Each of the fourth switching parts located at the $i^{th}$ horizontal line includes a first thin film transistor connected to an odd-numbered data line and the $i-1^{th}$ gate line. A second thin film transistor is connected to the first thin film transistor and the $i^{th}$ gate line and connected to a liquid crystal cell located at a $j+2^{th}$ (where j is 2, 6, 10, . . . ) vertical line.

Each of the first switching parts located at the $i+1^{th}$ horizontal line includes a first thin film transistor connected to an even-numbered data line and the $i^{th}$ gate line. A second thin film transistor is connected to the first thin film transistor and the $i^{th}$ gate line and connected to a liquid crystal cell located at a $j+2^{th}$ (where j is 2, 6, 10, . . . ) vertical line.

Each of the second switching parts located at the $i+1^{th}$ horizontal line includes a first thin film transistor connected to an odd-numbered data line and the $i^{th}$ gate line. A second thin film transistor is connected to the first thin film transistor and the $i^{th}$ gate line and connected to a liquid crystal cell located at a $j-1^{th}$ (where j is 2, 6, 10, . . . ) vertical line.

Each of the third switching parts located at the $i+1^{th}$ horizontal line includes a first thin film transistor connected to an odd-numbered data line and the $i^{th}$ gate line. A second thin film transistor is connected to the first thin film transistor and the $i+1^{th}$ gate line and connected to a liquid crystal cell located at a $j+1^{th}$ (where j is 2, 6, 10, . . . ) vertical line.

Each of the fourth switching parts located at the $i+1^{th}$ horizontal line includes a first thin film transistor connected to an odd-numbered data line and the $i^{th}$ gate line. A second thin film transistor is connected to the first thin film transistor and the $i+1^{th}$ gate line and connected to a liquid crystal cell located at a $j^{th}$ (where j is 2, 6, 10, . . . ) vertical line.

The data driver supplies the video signals to the third and the fourth switching parts when the second gate signal is applied to the $i-1^{th}$ gate line and the first gate signal is applied to the $i^{th}$ gate line. Further, the data driver supplies the video signals to the first and the second switching parts when the first gate signal has fallen, so that only the second gate signal is applied to the $i-1^{th}$ gate line.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

These and other objects of the invention will be apparent from the following detailed description of the embodiments of the present invention with reference to the accompanying drawings, in which:

FIGS. 3A and 3B illustrate a column inversion driving method of a liquid crystal display, in accordance the background art;

FIGS. 4A and 4B illustrate a dot inversion driving method of a liquid crystal display, in accordance the background art;

DETAILED DESCRIPTION OF THE PREFERRED EMBODIMENT

Figure 5:
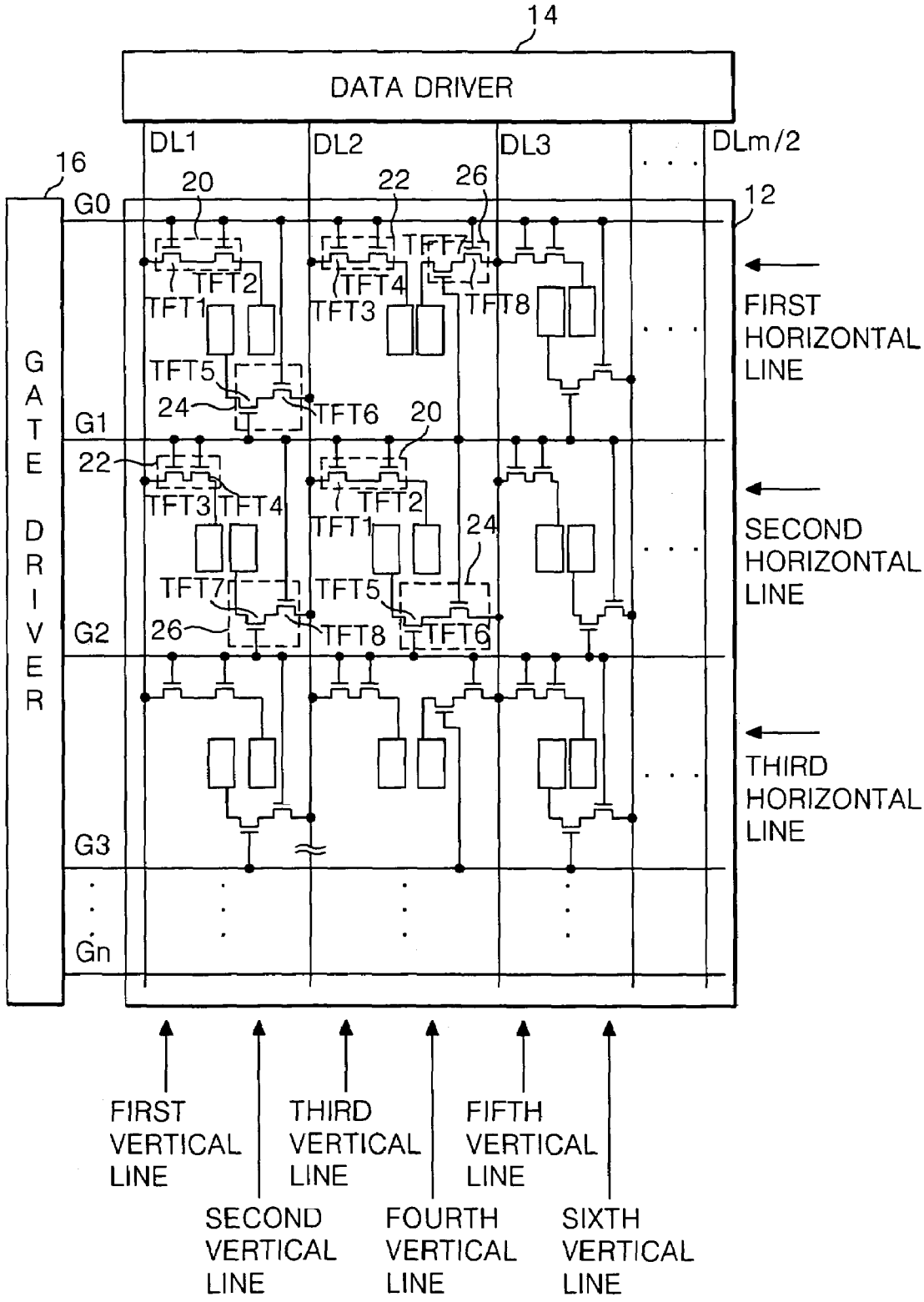
FIG. 5 illustrates a liquid crystal display, according to an embodiment of the present invention.

Hereinafter, a preferred embodiment of the present invention will be described in detail with reference to FIGS. 5 to 8B. FIG. 5 illustrates a liquid crystal display according to the preferred embodiment of the present invention.

As shown in FIG. 5, the liquid crystal display includes a liquid crystal display panel 12, wherein liquid crystal cells are arranged in a matrix. A gate driver 16 drives a plurality of gate lines G0 to Gn of the liquid crystal display panel 12. A data driver 14 drives a plurality of data lines DL1 to DLm/2 of the liquid crystal display panel 12.

In the liquid crystal display panel 12, the data lines DL1 to DLm/2 are isolated from and cross the gate lines G0 to Gn. The liquid crystal display panel 12 further includes the liquid crystal cells formed between pixel electrodes and common electrodes. Since the pixel electrodes are arranged in a matrix on the liquid crystal display panel 12, the liquid crystal cells are also arranged in a matrix on the liquid crystal display panel 12.

In addition, the liquid crystal display panel 12 includes first switching parts 20 to fourth switching parts 26 for applying video signals to the liquid crystal cells. Each of the first switching parts 20, the second switching parts 22, the third switching parts 24 and the fourth switching parts 26 drives one liquid crystal cell. Moreover, the first switching parts 20 to the fourth switching parts 26 are arranged in an alternately repeating pattern.

To describe this repeating arrangement in detail, the first switching parts 20 located at $i^{th}$ (i is a natural number) horizontal line include a first thin film transistor TFT1 and a second thin film transistor TFT2. A gate terminal of the first thin film transistor TFT1 and a gate terminal of the second thin film transistor TFT2 are connected to a gate line Gi−1 forming an $i-1^{th}$ horizontal line. The first thin film transistor TFT1 is connected to the data line DL, and the second thin film transistor TFT2 is located between the first thin film transistor TFT1 and the liquid crystal cell. In other words, the first switching parts 20 located at the $i^{th}$ horizontal line apply video signals from the data line DL to the liquid crystal cells when the gate signal is applied to the $i-1^{th}$ gate line Gi−1. Therefore, the first switching parts 20 located at the $i^{th}$ horizontal line drive the liquid crystal cells located at $j^{th}$ (where j is 2, 6, 10, . . . ) vertical lines.

The second switching parts 22 located at the $i^{th}$ horizontal line include a third thin film transistor TFT3 and a fourth thin film transistor TFT4. A gate terminal of the third thin film transistor TFT3 and a gate terminal of the fourth thin film transistor TFT4 are connected to the gate line Gi−1 forming the $i-1^{th}$ horizontal line. The third thin film transistor TFT3 is connected to the data line DL, and the fourth thin film transistor TFT4 is located between the third thin film transistor TFT3 and the liquid crystal cell. In other words, the second switching parts 22 located at the $i^{th}$ horizontal line apply video signals from the data line DL to the liquid crystal cells when the gate signal is applied to the $i-1^{th}$ gate line Gi−1. Therefore, the second switching parts 22 located at the $i^{th}$ horizontal line drive the liquid crystal cells located at the $j+1^{th}$ vertical lines.

The third switching parts 24 located at the $i^{th}$ horizontal line include a fifth thin film transistor TFT5 and a sixth thin film transistor TFT6. A gate terminal of the fifth thin film transistor TFT5 is connected to the gate line Gi forming the $i^{th}$ horizontal line, and a gate terminal of the sixth thin film transistor TFT6 is connected to the gate line Gi−1 forming the $i-1^{th}$ horizontal line. The sixth thin film transistor TFT6 is connected to the data line DL, and the fifth thin film transistor TFT5 is located between the sixth thin film transistor TFT6 and the liquid crystal cell. In other words, the third switching parts 24 located at the $i^{th}$ horizontal line apply video signals from the data line DL to the liquid crystal cells when the gate signal is applied to the $i-1^{th}$ gate line Gi−1 and the $i^{th}$ gate line Gi. Therefore, the third switching parts 24 located at the $i^{th}$ horizontal line drive the liquid crystal cells located at $j-1^{th}$ vertical lines.

The fourth switching parts 26 located at the $i^{th}$ horizontal line include a seventh thin film transistor TFT7 and an eighth thin film transistor TFT8. A gate terminal of the seventh thin film transistor TFT7 is connected to the $i^{th}$ gate line Gi, and a gate terminal of the eighth thin film transistor TFT8 is connected to the $i-1^{th}$ gate line Gi−1. The eighth thin film transistor TFT8 is connected to the data line DL, and the seventh thin film transistor TFT7 is located between the eighth thin film transistor TFT8 and the liquid crystal-cell. The fourth switching parts 26 located at the $i^{th}$ horizontal line apply video signals from the data line DL to the liquid crystal cells when the gate signal is applied to the $i-1^{th}$ gate line Gi−1 and the $i^{th}$ gate line Gi. Therefore, the fourth switching parts 26 located at the $i^{th}$ horizontal lines drive the liquid crystal cells located at $j+2^{th}$ vertical lines.

To summarize, the first switching parts 20 located at the $i^{th}$ horizontal line supply video signals to the liquid crystal cells located at $j^{th}$ (where j=2, 6, 10, 14 . . . ) vertical lines when the gate signal is applied to the $i-1^{th}$ gate line Gi−1. The second switching parts 22 located at the $i^{th}$ horizontal line apply video signals to the liquid crystal cells located at $j+1^{th}$ vertical lines when the gate signal is applied to the $i-1^{th}$ gate line Gi−1. The third switching parts 24 located at the $i^{th}$ horizontal line apply video signals to the liquid crystal cells located at $j-1^{th}$ vertical lines when the gate signal is applied to the $i^{th}$ gate line Gi and the $i-1^{th}$ gate line Gi−1. Finally, the fourth switching parts 26 located at the $i^{th}$ horizontal line apply video signals to the liquid crystal cells located at $j+2^{th}$ vertical lines when the gate signal is applied to the $i^{th}$ gate line Gi and the $i-1^{th}$ gate line Gi−1.

In one embodiment of the present invention, the first switching part 20 and the fourth switching part 26 are supplied with the video signals from a common adjacent data line DL. In other words, the first switching part 20 and the fourth switching part 26 share a data line DL. Also, the second switching part 22 and the third switching part 24 are supplied with the video signals from a common adjacent data line DL. In other words, the second switching part 22 and the third switching part 24 share a data line DL. For instance, the fourth switching part 26 (located at the fourth vertical line and first horizontal line) and the first switching part 20 (located at the sixth vertical line and first horizontal line) are connected to the third data line DL3. As another example, the second switching part 22 (located at the third vertical line and first horizontal line) and the third switching part 24 (located at the first vertical line and first horizontal line) are connected to the second data line DL2.

Figure 1:
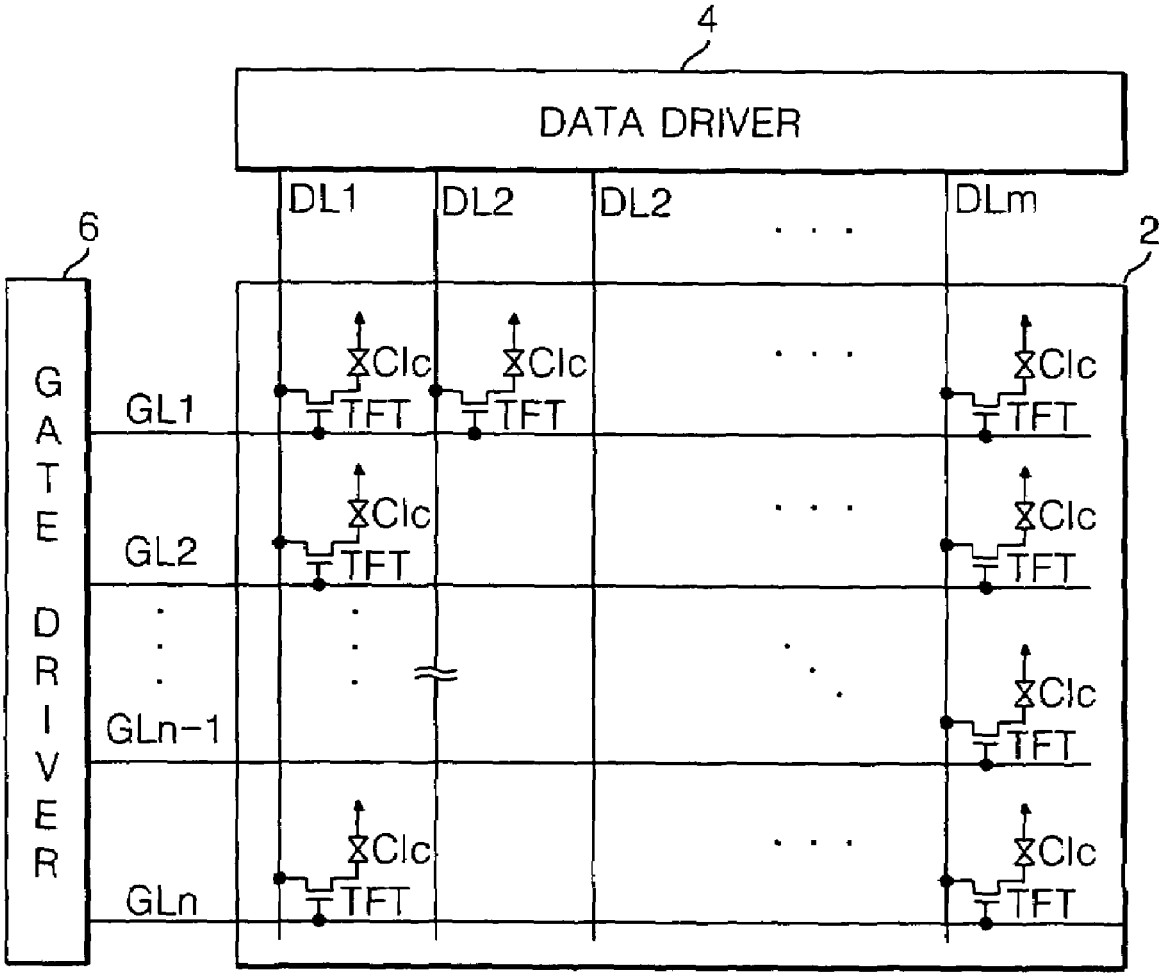
FIG. 1 RELATED ART
FIG. 1 illustrates a liquid crystal display, in accordance the background art.
Figure 2A:
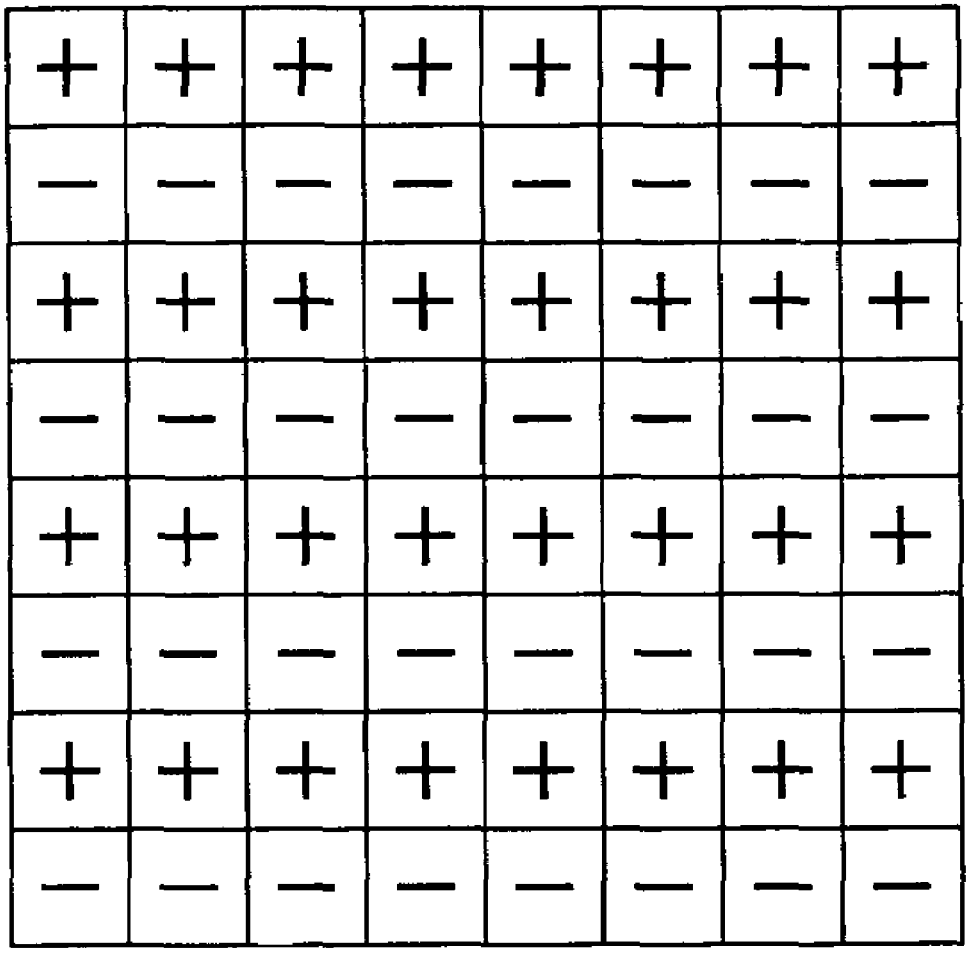
FIG. 2A RELATED ART
FIGS. 2A and 2B illustrate a line inversion driving method of a liquid crystal display, in accordance the background art.
Figure 2B:
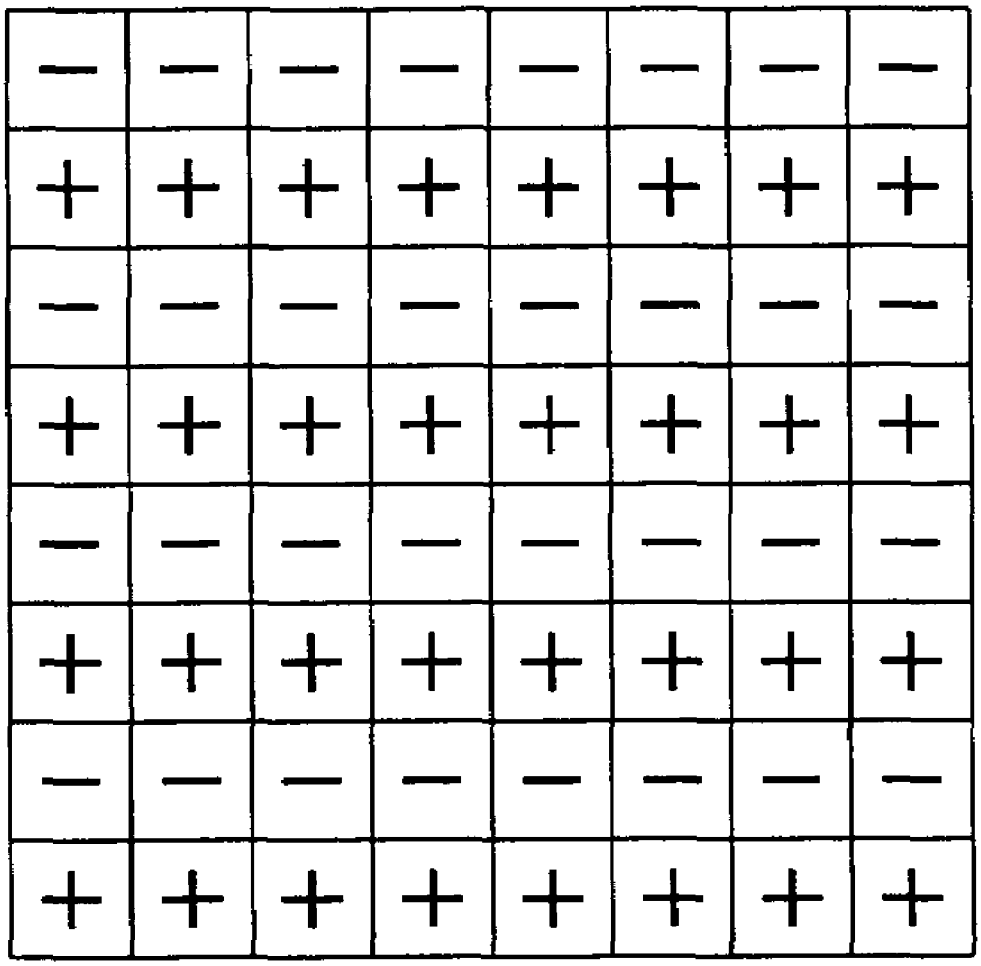
FIG. 2B RELATED ART

In the liquid crystal display of the present invention, the number of data lines DL is decreased by half, as compared with the liquid crystal display of the background art shown in FIG. 1. Namely, the number of data lines DL is decreased by half, because each data line can drive a liquid crystal cells located to its left and right sides. Further, the number of data integrated circuits, included in the data driver 14, is also decreased by half accordingly.

The locations of the first switching parts 20 to the fourth switching parts 26 are arranged in a zigzag pattern relative to the data line for each horizontal line. In other words, the first switching parts 20, located along the $i+1^{th}$ horizontal line, are arranged to apply the video signals to the liquid crystal cells located at the $j+2^{th}$ vertical lines. The second switching parts 22 located along the $i+1^{th}$ horizontal line are arranged to apply the video signals to the liquid crystal cells located at the $j-1^{th}$ vertical lines. The third switching parts 24 located along the $i+1^{th}$ horizontal line are arranged to apply the video signals to the liquid crystal cells located at the $j+1^{th}$ vertical lines. Finally, the fourth switching parts 26 located along the $i+1^{th}$ horizontal line are arranged to apply the video signals to the liquid crystal cells located at the th vertical lines.

Figure 6:
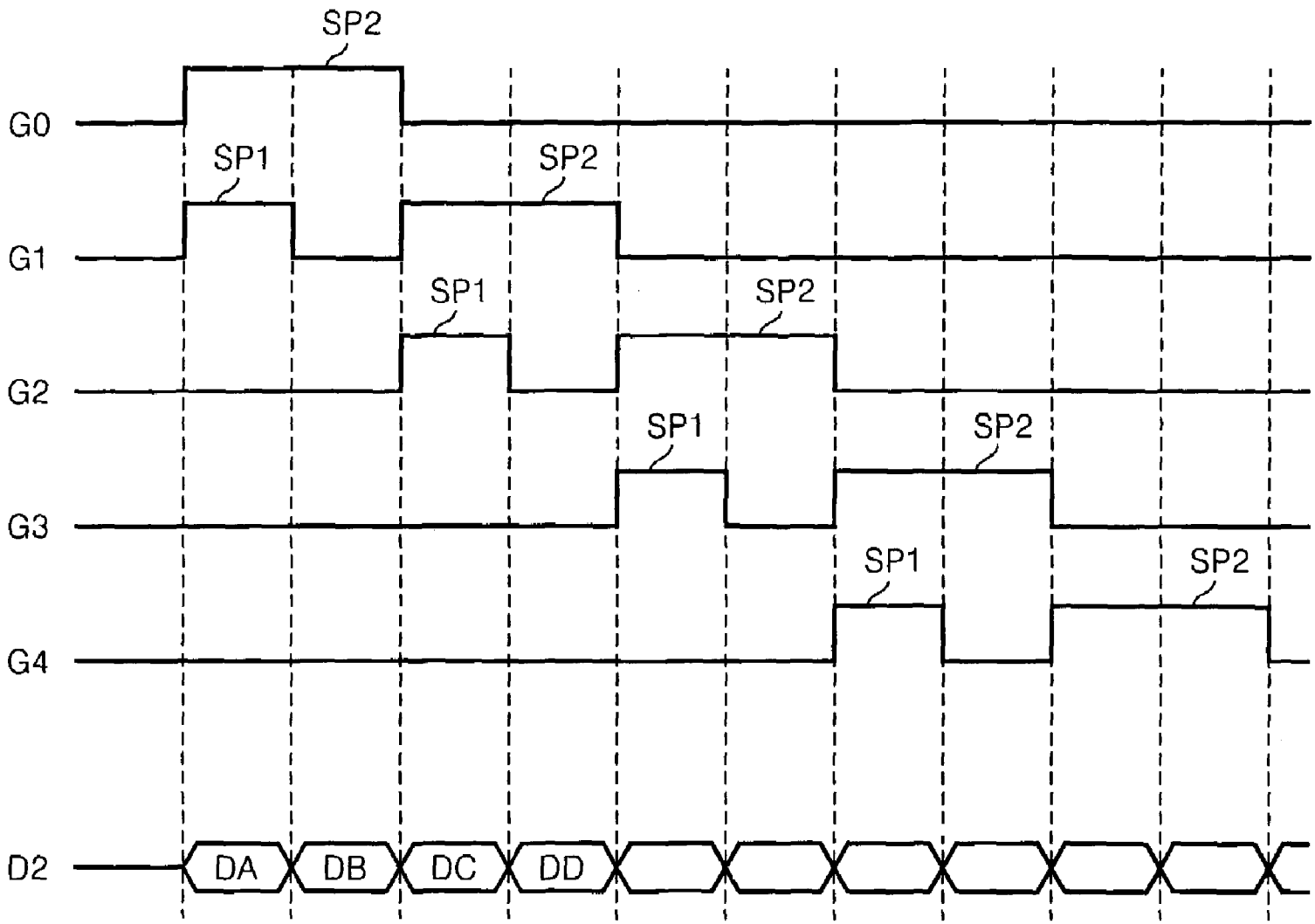
FIG. 6 is a waveform diagram representing gate signals applied from the gate driver to the gate lines shown in FIG. 5.

As illustrated in FIG. 6, the gate driver 16 sequentially supplies a first gate signal SP1 and a second gate signal to the gate lines G0 to Gn. The first gate signal SP1 applied to the $i^{th}$ gate line Gi is applied overlapping with the second gate signal SP2 applied to the $i-1^{th}$ gate line Gi−1. The first gate signal SP1 applied to the $i^{th}$ gate line Gi is substantially increased at the same point in time with the second gate signal SP2 applied to the $i-1^{th}$ gate line Gi−1. In other words, the signal SP1 applied to the $i^{th}$ gate line Gi starts at substantially the same time as the second gate signal SP2 applied to the $i-1^{th}$ gate line Gi−1.

The second gate signal SP2 is set to have a width (or time duration) wider than the first gate signal SP1. For instance, the second gate signal SP2 can have a width twice that of the first gate signal SP1.

The data driver 14 supplies the video signals to be applied to the liquid crystal cells connected to the third switching part 24 and the fourth switching part 26 for a period that the first gate signal SP1 and the second gate signal SP2 are overlapped. The data driver 14 supplies the video signals to be applied to the liquid crystal cells connected to the first switching part 20 and the second switching part 22 for a period when only the second gate signal SP2 is applied. Moreover, the data driver 14 applies the video signals using the column inversion method.

The operation will now be described in more detail with reference to FIGS. 5 and 6. First, the second gate signal SP2 is applied to the zero gate line G0, and the first gate signal SP1 is applied to the first line G1. In this case, the thin film transistors TFT1 to TFT8 included in the first switching part 20 to the fourth switching part 26 (located in the first horizontal line) and having their gates connected to gate line G0 are turned on. Also, the thin film transistors TFT1 to TFT8 included in the first switching part 20 to the fourth switching part 26 (located in the second horizontal line) and having their gates connected to gate line G1 are turned on by the first gate signal SP1 applied to the first gate line G1.

Figure 7:
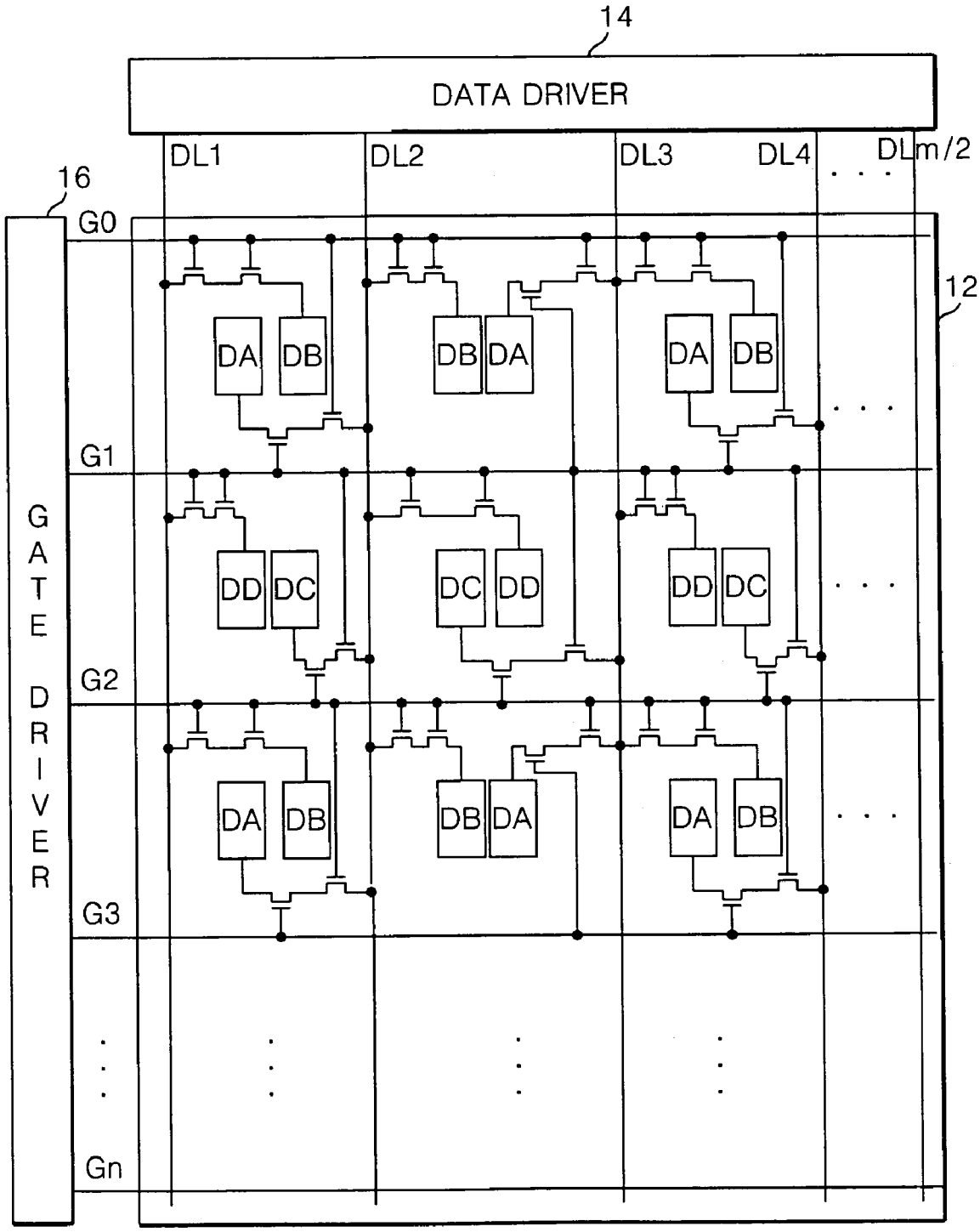
FIG. 7 illustrates a process wherein video signals are applied to the liquid crystal display panel shown in FIG. 5.

As a result, video signals applied to the liquid crystal cells connected to the third switching part 24 and the fourth switching part 26 (located in the first horizontal line) are applied to the data lines DL1 to DLm/2. For instance, if the video signal DA is applied, a desired video signal DA is applied to the liquid crystal cells connected to the third switching part 24 and the fourth switching part 26 as shown in FIG. 7. The video signal DA is applied to the liquid crystal cells connected to the first switching part 20 and the second switching part 22 (located in the first and the second horizontal lines), but the video signal DA is a dummy video signal charged for a short time.

Then, the first gate signal SP1 applied to the first gate line G1 falls off. If the first gate signal SP1 stops, only the thin film transistors TFT1 to TFT4 included in the first switching part 20 and the second switching part 22 remain in a turned-on state. As a result, the video signal applied to the liquid crystal cells connected to the first switching part 20 and the second switching part 22 (located in the first horizontal line) is applied to the data lines DL1 to DLm/2. For instance, if the video signal DB is applied, a desired video signal DB is applied to the liquid crystal cells connected to the first switching part 20 and the second switching part 22, as shown in FIG. 7. In other words, a desired video signal is supplied to the liquid crystal cells connected to the first and the second switching parts 20 and 22, instead of the dummy video signal supplied in a previous period.

After the desired video signal is supplied to the first switch part 20 and the second switching part 22, the second gate signal SP2 applied to the zero gate line G0 is turned off or stops. At this time, the second gate signal SP2 is applied to the first gate line G1, and the first gate signal SP1 is applied to the second gate line G2. Then, the thin film transistors TFT1 to TFT4 included in the first switching part 20 to the fourth switching part 26 (located in the second horizontal line) are turned on.

At this moment, the video signal applied to the liquid crystal cells connected to the third switching part 24 and the fourth switching part 26 (located in the second horizontal line) is applied to the data lines DL1 to DLm/2. For instance, if a video signal DC is applied, a desired video signal DC is applied to the liquid crystal cells connected to the first switching part 20 and the second switching part 22, as shown in FIG. 7.

Then, the second gate signal SP2 applied to the second gate line G2 is turned off. When the second gate signal SP2 stops, only the thin film transistors TFT1 to TFT4 included in the first switching part 20 and the second switching part 22 remain in a turned-on state. The video signal applied to the liquid crystal cells connected to the first switching part 20 and the second switching part 22 (located in the second horizontal line) is applied to the data lines DL1 to DLm/2. For instance, if the video signal DD as desired is applied, the desired video signal DD is applied to the liquid crystal cells connected to the first switching part 20 and the second switching part 22, as shown in FIG. 7. As a result, a desired video signal transmitted along one data line is applied to the liquid crystal cells located at the left and right sides using that one data line by repeating the described process in accordance with the present invention.

The data driver 14 applies the video signals using a column inversion method. In other words, the data driver 14 applies the video signals having polarities contrary to each other to the odd-numbered data lines DL1, DL3, . . . and the even-numbered data lines DL2, DL4, . . . . Then, the liquid crystal cells can be driven using a dot inversion method by the first switching part 20 to the fourth switching part 26 arranged in a zigzag relative to every horizontal line.

Figure 8A:
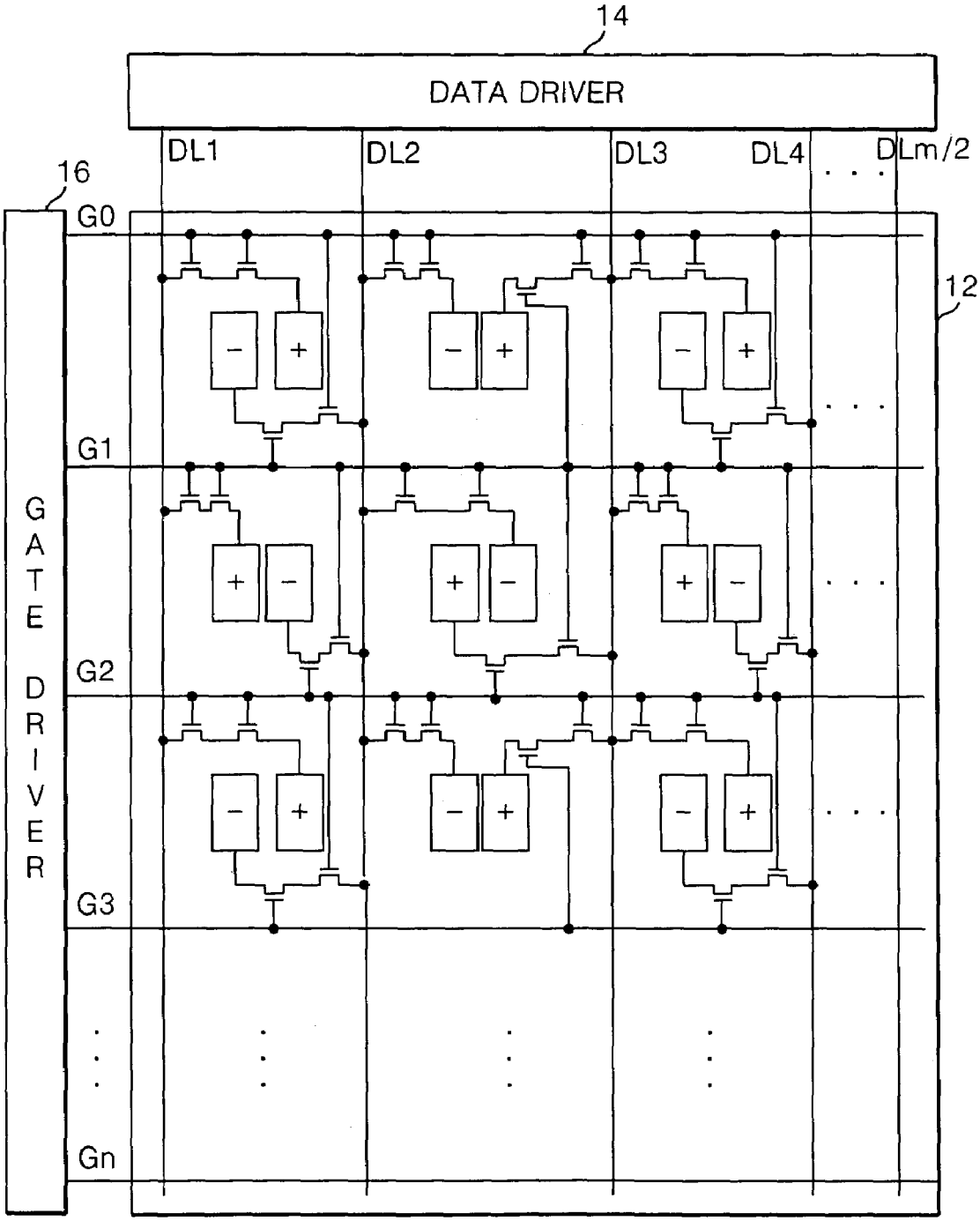
FIGS. 8A and 8B respectively illustrate polarities of video signals applied to a liquid crystal display panel when the video signals are applied by a column inversion method.

For instance, if a positive video signal is supplied to the odd-numbered data lines DL1, DL3, . . . and a negative videos signal is supplied to the even-numbered data lines DL2, DL4, . . . , as shown in FIG. 8A, the negative video signal is applied to the liquid crystal cells of the odd-numbered vertical lines located at the odd-numbered horizontal lines, and the positive video signal to the liquid crystal cells of the even-numbered vertical lines located at the even-numbered horizontal lines. Moreover, the positive video signal is applied to the liquid crystal cells of the odd-numbered vertical lines located at the even-numbered horizontal lines, and the negative video signal is applied to the liquid crystal cells of the even-numbered vertical lines located at the odd-numbered horizontal lines.

Figure 8B:
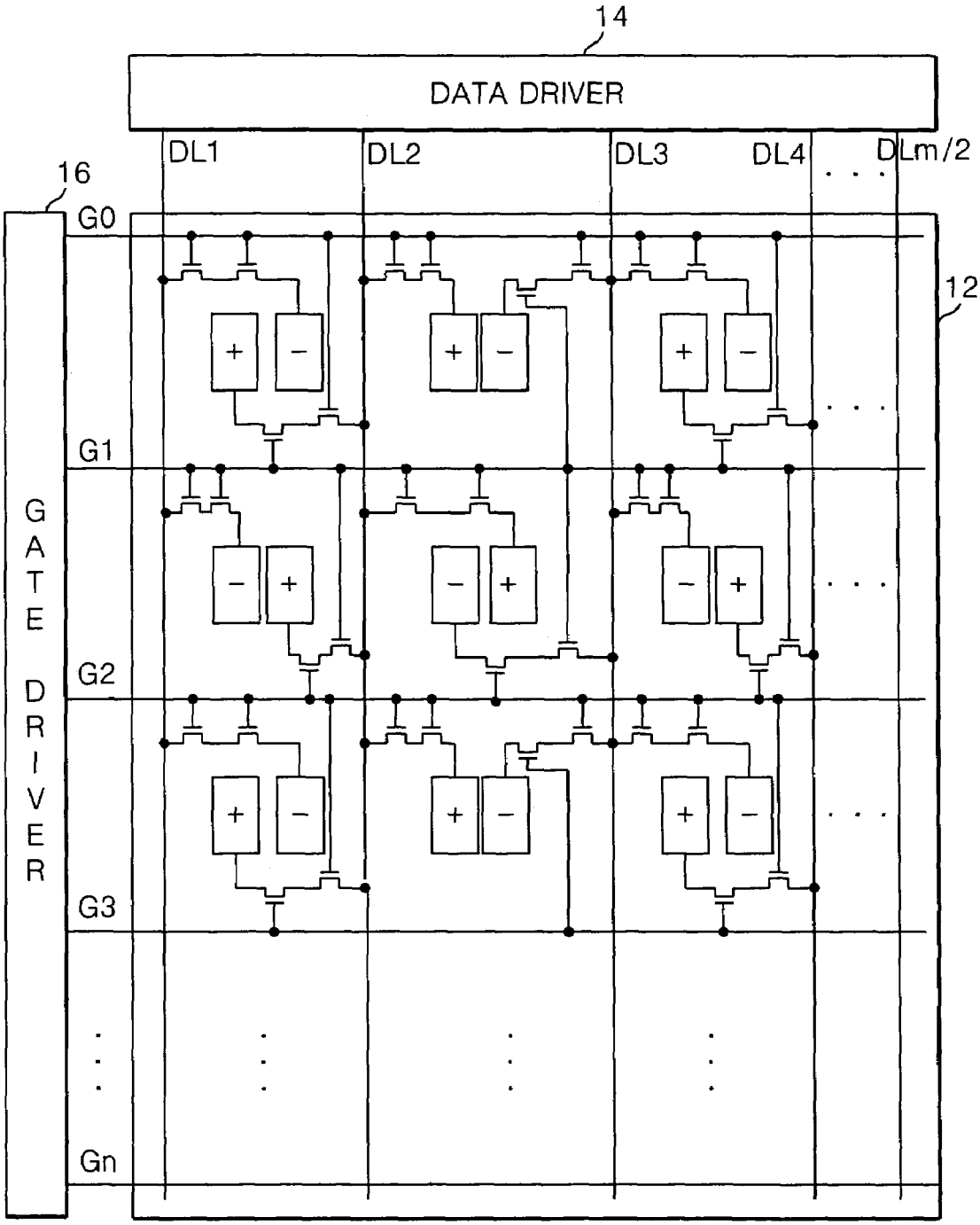

In addition, if a negative video signal is applied to the odd-numbered data lines DL1, DL3, . . . and a positive video signal to the even-numbered data lines DL2, DL4, . . . for the next frame period, as shown in FIG. 8B, the positive video signal is applied to the liquid crystal cells of the odd-numbered vertical lines located at the odd-numbered horizontal lines, and the negative video signal is applied to the liquid crystal cells of the even-numbered vertical lines located at the even-numbered horizontal lines. Moreover, the negative video signal is applied to the liquid crystal cells of the odd-numbered vertical lines located at the even-numbered horizontal lines, and the positive video signal is applied to the liquid crystal cells of the even-numbered vertical lines located at the odd-numbered horizontal lines. In other words, power consumption can be minimized by driving the liquid crystal cells using the dot inversion method in the present invention.

As described above, in the liquid crystal display of the present invention, the liquid crystal cells located at the left/right sides one data line are supplied a video signal from that one data line. Accordingly, the number of data lines is decreased by half, as compared with the liquid crystal displays of the background art. Accordingly, the number of data drivers applying the driving signals to the data lines is also decreased by half. Thus, it is possible to reduce a fabricating cost. Also, since the switching parts are arranged in a zigzag pattern relative to the data line for each horizontal line in the present invention, the liquid crystal cells can be driven by the dot inversion method, using a data driver of the column inversion method. In other words, since the liquid crystal cells are driven by the dot inversion method using the data driver of the column inversion method in the present invention, power consumption can be reduced without deterioration of a picture quality.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A liquid crystal display comprising:

a data driver for supplying video signals to data lines;

a gate driver for supplying a gate signals to each gate line;

a plurality of first switching parts and a plurality of second switching parts located in an $i^{th}$ horizontal line for supplying video signals to associated liquid crystal cells by the control of an $i-1^{th}$ gate line;

a plurality of third switching parts located in the $i^{th}$ horizontal line for applying video signals to associated liquid crystal cells by the control of the $i^{th}$ gate line and an $i-1^{th}$ gate line; and a plurality of fourth switching parts located in the $i^{th}$ horizontal line for applying video signals to associated liquid crystal cells by the control of the $i^{th}$ gate line and the $i-1^{th}$ gate line.

2. The liquid crystal display of claim 1, wherein the data driver supplies video signals to the data lines using a column inversion method.

3. The liquid crystal display of claim 1, wherein the plurality of third switching parts, located in the $i^{th}$ horizontal line, are connected to the same data line as the second switching part adjacent thereto.

4. The liquid crystal display of claim 1, wherein the plurality of fourth switching parts, located in the $i^{th}$ horizontal line, are connected to the same data line as the first switching part adjacent thereto.

5. The liquid crystal display of claim 1, wherein each of the first, second, third and fourth switching parts includes two thin film transistors, respectively.

6. The liquid crystal display of claim 1, wherein the gate driver supplies a first gate signal and a second gate signal to each gate line.

7. The liquid crystal display of claim 6, wherein the gate driver sequentially supplies a first gate signal and a second gate signal to each gate line.

8. The liquid crystal display of claim 6, wherein the first gate signal supplied to the $i^{th}$ gate line is supplied overlapping with the second gate signal supplied to the $i-1^{th}$ gate line.

9. The liquid crystal display of claim 8, wherein the first gate signal supplied to the $i^{th}$ gate line starts at substantially the same time as the second gate signal supplied to the $i-1^{th}$ gate line.

10. The liquid crystal display of claim 6, wherein a duration of the first gate signal is approximately half of a duration of the second gate signal.

11. The liquid crystal display of claim 1, wherein the first to the fourth switching parts are arranged in a zigzag pattern.

12. The liquid crystal display of claim 1, wherein each of the first switching parts located in the $i^{th}$ horizontal line includes:

a first thin film transistor connected to an odd-numbered data line and the $i-1^{th}$ gate line; and a second thin film transistor connected to the first thin film transistor and the $i-1^{th}$ gate line and connected to a liquid crystal cell located at a $j^{th}$ (where j is 2, 6, 10, . . . ) vertical line.

13. The liquid crystal display of claim 12, wherein each of the second switching parts located in the $i^{th}$ horizontal line includes:

a first thin film transistor connected to an even-numbered data line and the $i-1^{th}$ gate line; and a second thin film transistor connected to the first thin film transistor and the $i-1^{th}$ gate line and connected to a liquid crystal cell located at a $j+1^{th}$ (where j is 2, 6, 10, . . . ) vertical line.

14. The liquid crystal display of claim 13, wherein each of the third switching parts located at the $i^{th}$ horizontal line includes:

a first thin film transistor connected to an even-numbered data line and the $i-1^{th}$ gate line; and a second thin film transistor connected to the first thin film transistor and the $i^{th}$ gate line and connected to a liquid crystal cell located at a $j-1^{th}$ (where j is 2, 6, 10, . . . ) vertical line.

15. The liquid crystal display of claim 14, wherein each of the fourth switching parts located in the $i^{th}$ horizontal line includes:

a first thin film transistor connected to an odd-numbered data line and the $i-1^{th}$ gate line; and a second thin film transistor connected to the first thin film transistor and the $i^{th}$ gate line and connected to a liquid crystal cell located at a $j+2^{th}$ (where j is 2, 6, 10, . . . ) vertical line.

16. The liquid crystal display of claim 15, wherein each of the first switching parts located in the $i+1^{th}$ horizontal line includes:

a first thin film transistor connected to an even-numbered data line and the $i^{th}$ gate line; and a second thin film transistor connected to the first thin film transistor and the $i^{th}$ gate line and connected to a liquid crystal cell located at a $j+2^{th}$ (where j is 2, 6, 10, . . . ) vertical line.

17. The liquid crystal display of claim 16, wherein each of the second switching parts located in the $i+1^{th}$ horizontal line includes:

a first thin film transistor connected to an odd-numbered data line and the $i^{th}$ gate line; and a second thin film transistor connected to the first thin film transistor and the $i^{th}$ gate line and connected to a liquid crystal cell located at a $j-1^{th}$ (where j is 2, 6, 10, . . . ) vertical line.

18. The liquid crystal display of claim 17, wherein each of the third switching parts located in the $i+1^{th}$ horizontal line includes:

a first thin film transistor connected to a n odd-numbered data line and the $i^{th}$ gate line; and a second thin film transistor connected to the first thin film transistor and the $i+1^{th}$ gate line and connected to a liquid crystal cell located at a $j+1^{th}$ (where j is 2, 6, 10, . . . ) vertical line.

19. The liquid crystal display of claim 18, wherein each of the fourth switching parts located in the $i+1^{th}$ horizontal line includes:

a first thin film transistor connected to an odd-numbered data line and the $i^{th}$ gate line; and a second thin film transistor connected to the first thin film transistor and the $i+1^{th}$ gate line and connected to a liquid crystal cell located at a $j^{th}$ (where j is 2, 6, 10, . . . ) vertical line.

20. The liquid crystal display of claim 1, wherein the data driver supplies video signals to the third and the fourth switching parts located in the $i^{th}$ horizontal line when the second gate signal is applied to the $i-1^{th}$ gate line and the first gate, signal is applied to the $i^{th}$ gate line.

21. The liquid crystal display of claim 20, wherein the data driver supplies video signals to the first and the second switching parts located in the $i^{th}$ horizontal line when the first gate signal has stopped, so that only the second-gate signal is applied to the $i-1^{th}$ gate line.

22. A method of operating a liquid crystal display comprising:

supplying video signals to data lines of the liquid crystal display;

supplying gate signals to each gate line of the liquid crystal display;

controlling a plurality of first switching parts and a plurality of second switching parts located in an $i^{th}$ horizontal line using an $i-1^{th}$ gate line, so that the plurality of first switching parts and the plurality of second switching parts supply video signals from data lines to associated liquid crystal cells;

controlling a plurality of third switching parts located in the $i^{th}$ horizontal line using the $i^{th}$ gate line and an $i-1^{th}$ gate line, so that the plurality of third switching parts supply video signals from data lines to associated liquid crystal cells; and controlling a plurality of fourth switching parts located in the $i^{th}$ horizontal line using the $i^{th}$ gate line and the $i-1^{th}$ gate line, so that the plurality of fourth switching parts supply video signals from data lines to associated liquid crystal cells.

23. The method of claim 22, wherein said step of supplying video signals to data lines uses a column inversion method.

24. The method of claim 22, wherein the plurality of third switching parts, located in the $i^{th}$ horizontal line, are connected to the same data line as the second switching part adjacent thereto.

25. The method of claim 22, wherein the plurality of fourth switching parts, located in the $i^{th}$ horizontal line, are connected to the same data line as the first switching part adjacent thereto.

26. The method of claim 22, wherein each of the first, second, third and fourth switching parts includes two thin film transistors, respectively.

27. The method of claim 22, wherein said step of supplying gate signals includes supplying a first gate signal and a second gate signal to each gate line of the liquid crystal display.

28. The method of claim 27, wherein the first gate signal and the second gate signal are sequentially supplied to each gate line of the liquid crystal display.

29. The method of claim 27, wherein the first gate signal supplied to the $i^{th}$ gate line is supplied overlapping with the second gate signal supplied to the $i-i^{th}$ gate line.

30. The method of claim 29, wherein the first gate signal supplied to the $i^{th}$ gate line starts at substantially the same time as the second gate signal supplied to the $i-1^{th}$ gate line.

31. The method of claim 27, wherein a duration of the first gate signal is approximately half of a duration of the second gate signal.

32. The method of claim 31, wherein the first gate signal supplied to the $i^{th}$ gate line starts at substantially the same time as the second gate signal supplied to the $i-1^{th}$ gate line.

* * * * *